US010352668B1

(12) United States Patent
Hooke et al.

(10) Patent No.: US 10,352,668 B1
(45) Date of Patent: Jul. 16, 2019

(54) 81MM INCREASED LETHALITY PROJECTILE

(71) Applicant: The United States of America as Represented by the Secretary of the Army, Washington, DC (US)

(72) Inventors: Ryan Hooke, Huntsville, UT (US); Frank Munoz, West New York, NJ (US); Jack Pincay, Union City, NJ (US); James Hamfeldt, Randolph, NJ (US); Jeffrey R. Kraft, Newton, NJ (US); Gregory Nieradka, Succasunna, NJ (US); Eugene Schlenk, Succasunna, NJ (US); Donna Snyder, Hackettstown, NJ (US); Brett Barnes, Pen Argyl, PA (US); Andrew Maulbeck, Green Village, NJ (US); Gordon Cheung, Hackettstown, NJ (US); Tu-Nhi Nguyen, Morris Plains, NJ (US); Oscar Ruiz, Dover, NJ (US); Mitchell Stolk, Florham Park, NJ (US); Gerard Voorhis, Stroudsburg, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/855,066

(22) Filed: Dec. 27, 2017

Related U.S. Application Data

(60) Provisional application No. 62/439,628, filed on Dec. 28, 2016.

(51) Int. Cl.

| | |
|---|---|
| ***F42B 12/32*** | (2006.01) |
| ***F42B 12/74*** | (2006.01) |
| ***F42B 12/20*** | (2006.01) |
| ***F42C 19/02*** | (2006.01) |
| ***F42B 30/10*** | (2006.01) |

(52) U.S. Cl.
CPC ..... *F42B 12/32* (2013.01); *F42B 12/207* (2013.01); *F42B 12/74* (2013.01); *F42B 30/10* (2013.01); *F42C 19/02* (2013.01)

(58) Field of Classification Search
CPC ..... F42B 30/10; F42B 12/20; F42B 12/207; F42B 12/22; F42B 12/32; F42C 19/02
USPC ..... 102/496, 497, 372, 373
See application file for complete search history.

(56) References Cited

U.S. PATENT DOCUMENTS

| | | | | |
|---|---|---|---|---|
| 3,181,465 A * | 5/1965 | Anthony | ..... | F42B 12/76 102/445 |
| 3,882,779 A * | 5/1975 | Frostig | ..... | F42B 12/32 102/496 |
| 4,016,816 A * | 4/1977 | Larsson | ..... | F42B 12/32 102/494 |

FOREIGN PATENT DOCUMENTS

| | | | | |
|---|---|---|---|---|
| DE | 3433140 A1 * | 3/1986 | ..... | F42B 12/14 |
| DE | 3703773 A1 * | 8/1988 | ..... | F42B 12/32 |

* cited by examiner

*Primary Examiner* — James S Bergin
(74) *Attorney, Agent, or Firm* — Michael C. Sachs

(57) ABSTRACT

A mortar ammunition round which contains at least three fragment producing regions covered by a threadably removable aluminum cowling. Detachment of the cowling provides access to several of the fragment producing regions which are located on a removable cup device. A different cup device may then be selectively inserted and the cowling replaced, forming a new mortar round of different select performance capabilities.

10 Claims, 5 Drawing Sheets

81MM INCREASED LETHALITY PROJECTILE

CROSS REFERENCE TO RELATED APPLICATIONS

This application claims benefit under 35 USC 119 (e) from provisional application 62/439,628 filed Dec. 28, 2016, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

Mortars have been utilized since the beginning of siege warfare and were fast adopted by military forces world wide. Mortar systems consist of a short launching tube mounted above a hard plate area, into which a projectile is loaded usually from the muzzle end of the tube. The projectile is then fired using chemical combustion to generate large volumes of expanding gas that propell the projectile out of the tube muzzle end. Some mortars utilize a projectile that have a propelling charge system incorporated within the projectile itself. Older mortars place charges in the tube prior to the projectile's insertion. Mortars tubes are usually shorter than artillery tubes. With advancements in technology and materials, these (more compact) weapons became man transportable. Such allows for infantry to have size scaled down, artillery capabilities. Modern mortar munitions provide a wide range of capabilities. These range from providing illumination at night, providing smoke screens for defense, and also for delivering high explosive projectiles for offense. A modern compliment of mortar ammunition can include guided or smart mortar munitions. These can achieve pinpoint accuracy by correcting for errors attributable to wind, variations in atmospheric conditions such (as temperature and air density), and also for inaccurate aiming of a weapon. A purpose of this invention is to provide an insensitive munition ("IM") compliant, high explosive conventional mortar munition with also the following attributes: To achieve a significant increase to lethality in comparison to currently fielded munitions of the same caliber. To be producible at high rate volume in current U.S. high explosive production facilities, which quality would contribute to maintaining a U.S. production industry base. To permit a design that would allow for rapid adaption to changes in target requirements; provide a design that would facilitate spiral integration of emerging warhead technologies for more lethal and less sensitive warheads; and, have a design that is compliant to 1M standards. This invention also has the potential to be integrated into smart or guided mortar ammunition. The implementation of this invention into guided mortar ammunition designs presents the opportunity for superimposing the benefits of increased lethality with guided mortar capability. This could optimize the angle of fall for fragments, etc, to further enhance effectiveness. Key atributes of this invention are in mortar shape, fragmentation design, and in developmental processes of how this munition could be designed. This invention combines use of ingenious manufacturing specialties, technical innovations, optimization of the shape of the projectile for aerodynamics, and especial attention to cost, and life cycle management, to produce a unique solution which meets all the mission requirements. This includes system level engineering to understand the effect of a unitary warhead versus a two piece warhead on issues such as quality control and cost. This brings simultaneous optimization of cost, lethality, effectiveness, range, manufacturability, structural survivability, assembly and quality control. This was accomplished in part through the use of unique computer codes and simulations, cost and manufacturing models, material science considerations, and manufacturing process knowledge. Using computer simulations along with the aforementioned models, the designers created this comprehensive model. This unique design can be produced in current U.S. Government (USG) high explosive (HE) facilities at high production rates, with minimal facilities changes. It may be optimized for geometry and mass allocation of costly material by identifying how much kinetic energy is required in a fragment in order to produce a lethal effect on a known target at the range and angle of fall for a given system and munition. This allows designers to optimize the geometry and mass of the pre-formed fragments used in the design. Designers may couple pre-formed fragments, specifically sized for defeating personnel and materiel targets with conventional components that naturally fragment, into a unique munition. This munition design provides an optimal lethality solution in terms of cost of kill per unit mass for both personnel and materiel targets when fired from United States fielded M252, M252A1 and M252A2, 81 mm mortar systems. The benefit of this optimal mass distribution for lethality was maximized by changing projectile surface and shape to ensure that when detonated the resulting fragmentation pattern would provide the highest effects on targets. The unique profile for the exterior surface of the projectile was arrived at by optimizing the projection of the fragmentation spray covering the ground while taking into consideration the angle of fall and velocity of the projectile in conjunction with the manner in which the munition explodes. The designers were then able to map a projection of fragments onto the target area in order to increase the probability of kill (i.e. the probability of being hit by a lethal fragment), each fragment having its own vector. The designers tailored the shape so that the fragments and their resultant vectors would optimally cover an area on the ground. Velocity vectors are towards the target and not directly into the ground or away from the target. Additionally, the designers carefully chose material distribution through the combined consideration of structural requirements and aerodynamic attributes. This intentionally resulted in limited use of high strength and expensive materials to only the locations required in order to support gun launch survivability and fragment acceleration. Furthermore, the contour of the projectile was optimized to provide the lowest drag shape in the desired Mach regime, all the while maintaining a proper ratio of metal mass to high explosive charge. This extensive M&S optimization resulted in deliberate and discrete distributions of pre-formed fragments situated around the high explosive, coupled with natural fragmenting areas which produce discrete Gaussian distributions to just meet the requirements, but not excessively so. The designers also optimized the pre-formed fragment pusher plate to survive gun launch and to maximize the pre-formed fragment velocity by delaying venting during the initial breakup. Additionally, the pusher plate was consciously designed to break up into the proper mass and size distributions that also produce lethal personnel fragments. This invention is neither a purely naturally fragmenting warhead (with a Gaussian distribution), nor a purely pre-formed fragment warhead (with a discrete distribution).

Rather, the designers are using the naturally fragmenting material to both orient and locate the pre-formed fragments and to create discrete fragment distributions in combination with two Gaussian distributions centered around two different means, achieving a statistical advantage over pure pre-formed fragment or natural fragmentation warheads. This design allows for further optimization of the naturally occurring fragment sizes as well as the multiple pre-formed fragment sizes into one munition for different target types and sets. This is because the naturally fragmenting pusher plate material is acting on the pre-formed fragments to produce one Gaussian distribution while also exhibiting a second distribution in areas where it isn't pushing on pre-formed fragments. Since penetration requirements may vary from approximately 10 to 15 inches, a wide distribution of fragment mass and size is optimal against a wide range of possible targets. Furthermore, the designers designed and optimized the mass allocation of this projectile such that the center of gravity (C.G.) and mass moments can remain constant while the number and size of the pre-formed fragments is adjustable within a finite number of solutions within that net mass allocation. This means that the fragment sizes can be changed but the projectile aerodynamic characteristics will not be altered. Thus, 50 grams of metal can be 5 ten gram fragments, 10 five gram fragments or 2 twenty five gram fragments. They could be metallic, semi-metallic, ceramic, reactive, or any mixture of the above as long as the mass properties of their placement match the 50 grams of metal. Hence, if a target is no longer vulnerable to a 5 gram fragment, the individual pre-formed fragments can be interchanged with 10 gram fragments (as an example). This would result in five fewer total pre-formed fragments and a lower probability of hit by the pre-formed fragments, but will still meet the lethality and effectiveness requirements. This is because the number of fragments delivered for effectiveness is discontinuous (i.e., 1 round will deliver 100 fragments, two rounds 200 fragments total). As an example; if a target must sustain a hit from 155 fragments to statistically count as a kill, then 1.55 rounds are required to deliver that many fragments. This means one must fire 2 rounds total. Sometimes it may take 1.4 rounds, others times 1.6 rounds, depending on the standard deviation. In this case, one must fire 2 rounds to achieve the desired effect. If the number of fragments is reduced by 2%, to 98 fragments per round, it will still take between 1.7 and 1.9 rounds to kill the target, which still results in 2 rounds being required. So, depending on the target and the number of rounds needed to be effective, the total number of fragments in a round can be lowered without necessarily increasing the total number of rounds needed to defeat the target. Designing for spiral integration and rapid pre-formed fragmentation change in combination with the natural fragmentation being random prevents opposing forces from producing protection systems which are designed to defeat the exact fragment size of our munition since this design is inherently adaptable in terms of fragmentation characteristics. The solution the designers arrived at results in multiple sizes of pre-formed fragments being located on the outside circumference of the projectile in the forward two thirds of the projectile. Having the pre-formed fragments located in the front of the projectile was also chosen for both lethality and the ability to prevent obscurence of the explosive during inspection for critical defects. All rounds must go through x-ray, and sharp material discontinuities or high density materials tend to scatter or stop x-rays and prevent inspection of the high explosive fill for density variations. Thus, if the pre-formed fragments were in the rear of the projectile, one might not be able to x-ray through the case wall and know if there was a base gap separation, which would detonate if fired, killing the gun crew. Thus, all pre-formed fragments and discontinuities are located in the case wall in areas where major deformities in the high explosive fill will not lead to an inbore or safety incident. Hence one wouldn't have to know whether a small void does or doesn't exist in the area because it doesn't, affect the safety of the projectile, given the specific explosive fill chosen by the designers. The pre-formed fragments may also be loaded after the explosive has gone through its inspection and quality control at the Load Assembly and Packout facility if a different explosive requires new inspection requirements.

OBJECTS OF THE INVENTION

It is an object of this invention to provide a mortar which contains at least three separate fragment producing regions in which certain fragment producing regions may be selectively removed and manually changed.

Another object of this invention is to provide a less sensitive cost efficient 81 MM mortar ammunition round with selective fragment producing components which may defeat vehicles and armor as well as defeat personnel.

A still further object of this invention is to provide a mortar with nose area covered over by a threadably removable aluminum cowling for manual access to several fragment producing regions underneath, for selective change of fragment bands in those regions.

A yet further object of this invention is to provide a mortar in which detachment of a frontal cowling provides access to several fragment producing regions located on removable cup devices, and different cup devices may then be selectively inserted forming a new mortar of different select performance capabilities.

LIST OF DRAWINGS

Figure 3:
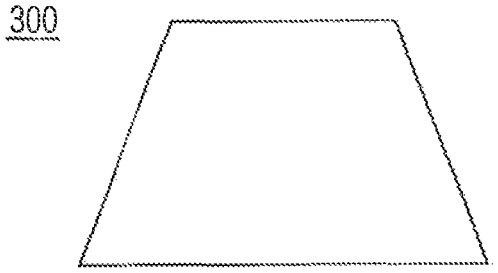

FIG. 3 shows a hollow spacer 300 sized to fit completely over an upper piece 202 of the fragment containing device 200 of a mortar ammunition round, according to this invention.

Figure 4:
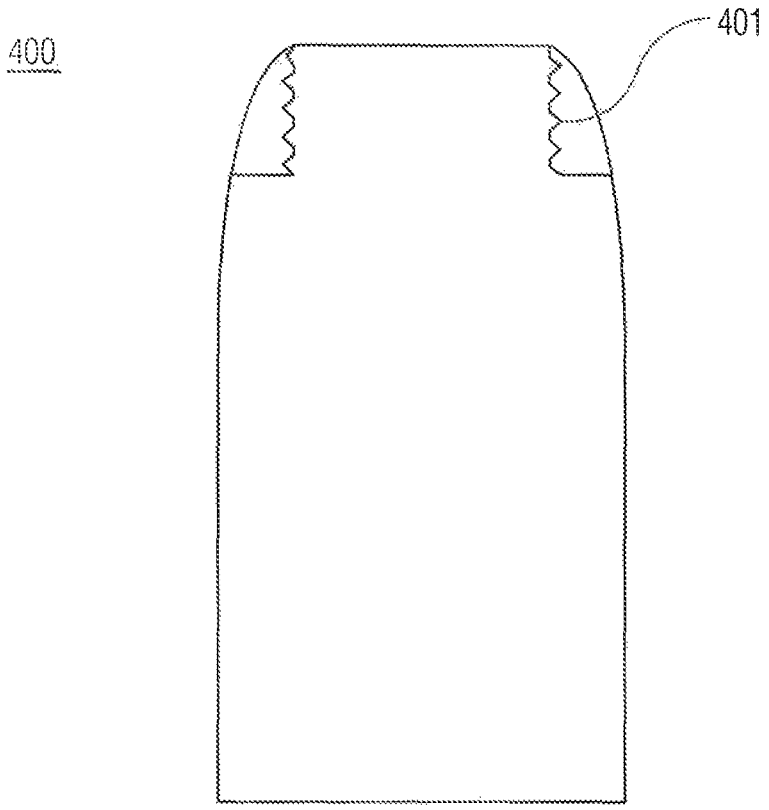

FIG. 4 shows an aluminum cowling 400 which may be selectively emplaced over the fragment containing device 200 and projectile main body piece 100 of the mortar ammunition round, according to this invention.

Figure 5:
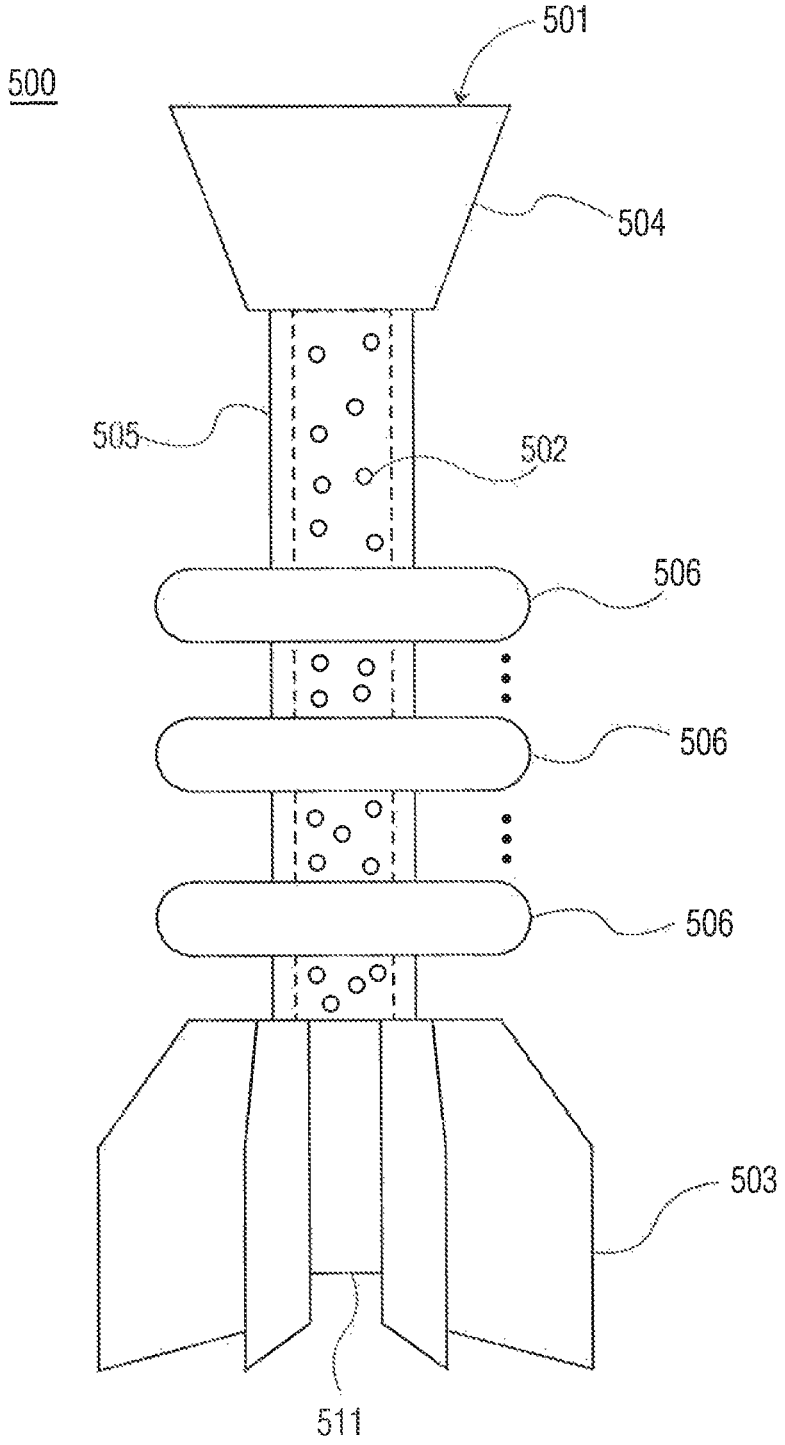

FIG. 5 shows a hollow attachable tail piece 500 which facilitates attachment of tail fins 503 upon fin assembly 511 of a mortar ammunition round, according to this invention.

Figure 6:
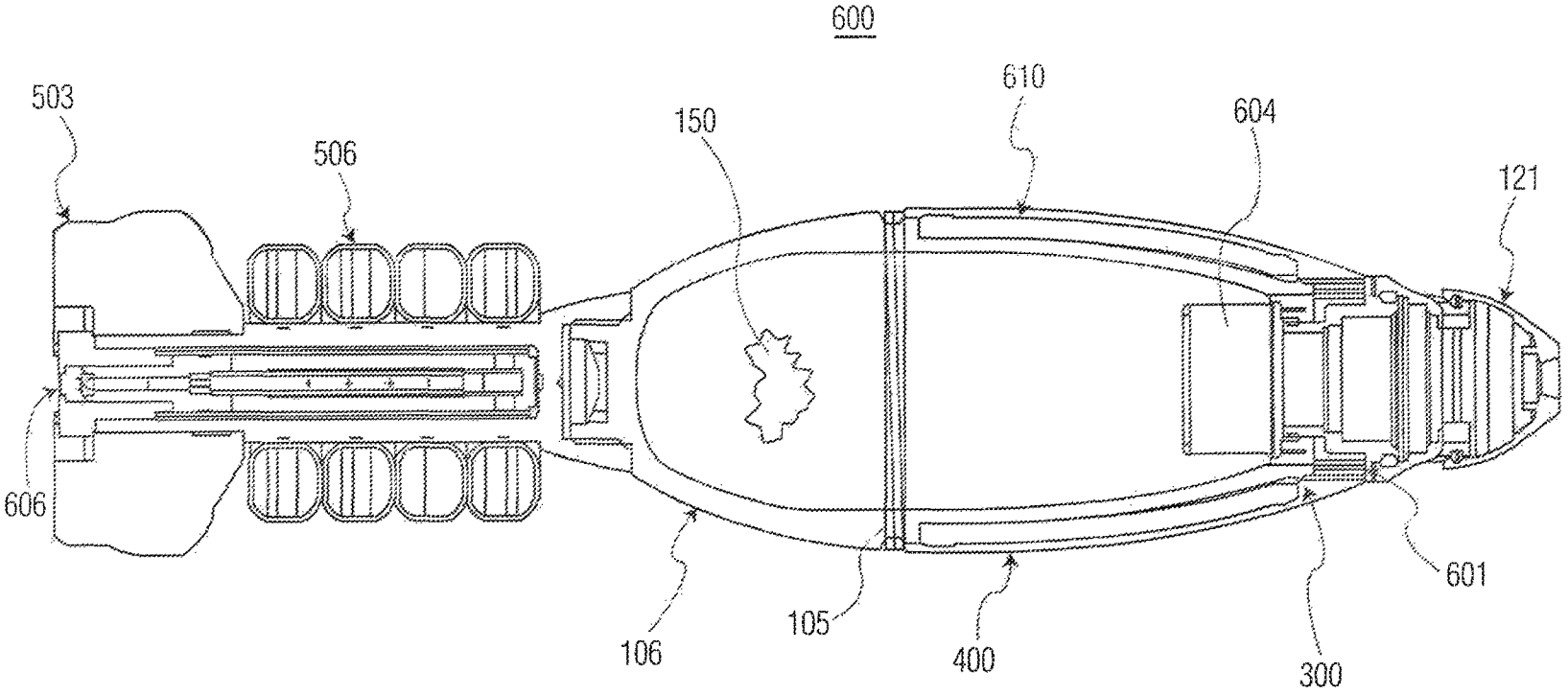

FIG. 6 shows a cross sectional view of an M821A3E1-81 mm (ILP) Increased Lethality Projectile 600 according to this invention.

DETAILED DESCRIPTION

Figure 1:
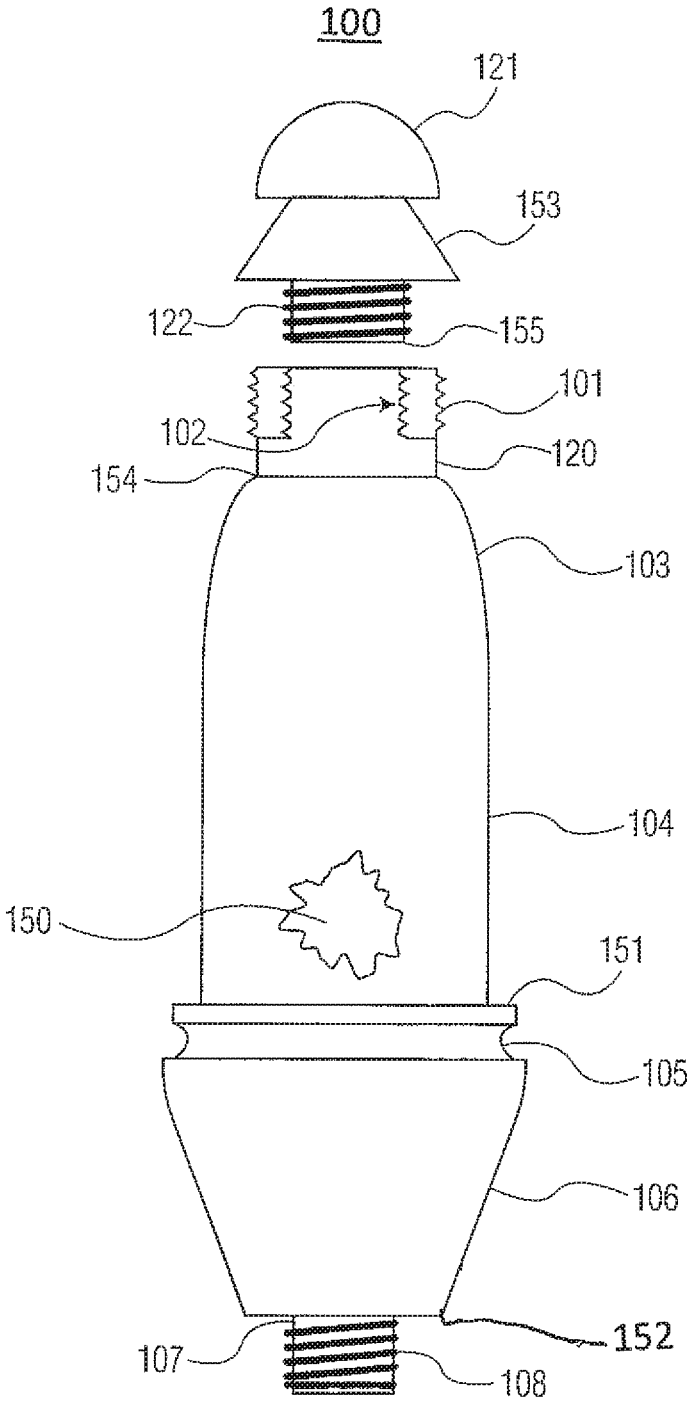
FIG. 1 shows the projectile main body piece 100 of a mortar ammunition round according to this invention.

FIG. 1 shows the projectile main body piece 100. Main body piece 100 is made by cutting and repurposing an HF-1 steel body casing as have been used on legacy M821 mortars. This means it is already designed to fragment into many heavy pieces which upon explosion of the mortar body are intended to rain down upon a designated ground target.

Figure 2:
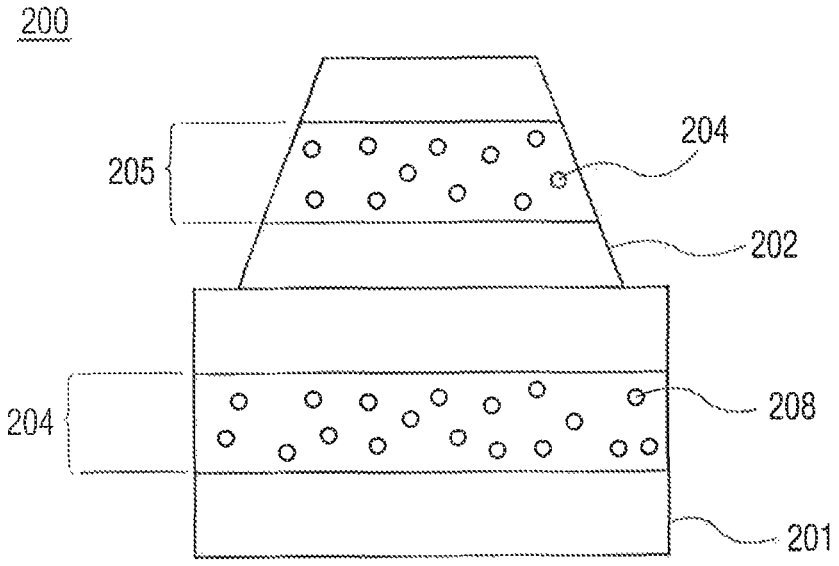
FIG. 2 shows a fragment containing device 200 sized to be selectively emplaced over or selectively removed from the projectile main body piece 100 of a mortar ammunition round, according to this invention.

This will be viewed as the first of three to even five different sources of fragments that are designated in this new mortar round to attack the intended target. Other bands of fragments 204 and 205 will later be described with respect to fragment containing device 200. Main body piece 100 contains a payload of high explosive 150 which for this round will be IMX-104 explosive. Although IMX-104 is more expensive than, e.g., current composition B, for instance, IMX-104 is a new less sensitive type explosive which is therefore considered safer. The round also Includes a fuze 121 mounted on a fuze adapter 153 which in turn has a bottom piece 155 which bottom piece has external threads 122 at its lower extremities. Cowling 400 (later described with reference to FIG. 4, has internal threads 401 mating with 122 to receive the fuze adapter piece 155. Cowling 400 abuts ledge 151 on the main piece when the cowling is snugly in place. Main piece 100 comprises a hollow fragmenting body, HF-1 steel casing, having a cylindrical top threaded region 120 which has both external threads 101 and internal threads 102 which internal threads 102 mate to the external threads 122 of fuze 121. The external threads 101 mate with internal threads 401 on cowling 400. The cowling 400 ultimately is screwed in place down to ledge 151 enclosing internal parts 200 and 300 (described with respect to FIGS. 2 and 3) are emplaced. The main piece 100 has an aerodynamically contoured section 103 starting at line 154 which is bottom of said top threaded region 120, and a straight cylindrical area 104 below said contoured section 103. The aerodynamically contoured section 103 has specially chosen radii to best explode down upon the desired target. The main body piece 100 has a circumferential obturator slot 105 engraved circumferentially below said ledge 151 which ledge is at the bottom of said straight area 104. The main body piece 100 also has a tapered down area 106 below said circumferential obturator slot 105, which leads down to bottom line 152, below which is formed a cylindrical bottom threaded region 107. The bottom threaded region 107 has outer threads 108 which facilitate attachment of a hollow tail piece 500 (FIG. 5). Hollow tail piece 500 has a top tail piece 504 with internal threads 501 which mate to outer threads 108 of said bottom threaded region 107. Hollow tail piece 500 also has a tail tube piece 505 having multiple holes 502 therein and carries oversized hollow propellant bodies 506 mounted thereon, resembling donut shapes. Hollow tail piece 500 also has a fin assembly 511 at base of said tail tube piece 505, said fin assembly 511 having five fins 503 thereupon. FIG. 2 shows a fragment containing device 200 sized to be selectively emplaced over or selectively removed from, said straight area 104 of said main piece 100 and said specially contoured section 103. Said fragment containing device 200 comprises a lower hollow cylindrical cup area 201 and an upper rounded hollow piece 202 having special radius shape to agree to outer shape 103 of the main body piece 100, wherein a band 204 of vehicle/armor defeating large metal ball fragments 208 are embedded within the outside surface of cup area 201 and a band 205 of personnel defeating smaller metal ball fragments 209 are embedded within the outside surface of rounded hollow piece 202. FIG. 3 shows a hollow spacer 300 sized to snugly fit completely over the upper rounded hollow piece 202 of the fragment containing device 200. As shown, spacer 300 has a height equal to the height of 202 on cup 200 to insure a smooth contoured fit, and then the cowling 400 will be screwed down in place to snugly cover over elements 200 and 300 and snugly hold them in place. Though spacer 300 is shown here to lie over 202 on element 200, however in other embodiments, spacer 300 could be made to fit within upper rounded hollow piece 202 instead. Fragments 208, 209 lie within the surfaces of cup area 201 and 202 respectively but could also lie underneath, on top thereof, of some combination of all upper rounded hollow piece 202 three places depending upon the respective sizing thereof. The fragments may be made of heavy metals such as steel, tungsten, etc., and may have heavy 2.5 grain sized fragments. The fragments may be balls but may comprise other geometric shapes. Because sections 200 and 300 may be selectively removed, replaced, or refurbished, this makes for a round which is versatile in manufacturing. Most parts remain the same whilst sections 200 and 300 may alone be need to be changed. The 200 and 300 devices are covered over by an aerodynamically shaped hollow aluminum cowling 400 having in its top part, internal threads 401 which are sized to screw down over outer threads 101 of the main piece 100. The cowling reaches down to where obturator 105 is located and rests there when the cowling is fully screwed down. The cowling (400) may also be metallic, polymer, ceramic, or of a composite material.

FIG. 6 shows a cross sectional view of an M821A3E1-81 mm Increased Lethality Projectile (ILP), 600. Here, a tungsten preformed fragmentation matrix 610 is mounted on the foreword body of the mortar round, overlaying an HF-1 steel shell body component 100. Spacer 300 provides partial support for the fragmentation matrix 610. Spacer 300 may lay over, or underneath the fragmentation matrix 610. Component 100 is made from a HF-1 mortar body, but turned around 180 degrees in direction, and cut to fit this application. Therefore, it is an inexpensive round body to obtain, and it also fragments as desired, to serve as a pusher for the fragmentation matrix 610. An aluminum cowling 400 overlays and covers, as a minimum, the fragmentation matrix 610. This round contains a payload of high explosive 150 of IMX-104 explosive, which is less sensitive though more expensive than Composition B explosive, e.g. Round 600 also contains a fuze 121 on an 1M fuze adapter 601. It has an engraved obturator notch 105 ahead of the backward tapered region 106 where found located are fins 503 on a fin assembly (M24 type), propellant charges 506, (modified M220 type), and ignition cartridge 606, (M299 type). The round 600 also has a booster 604.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A less sensitive greater effectivity mortar ammunition round comprising:

a fuze (121) having external threads (122) at its lower extremities;

a main piece (100), said main piece comprising a hollow fragmenting body, HF-1 steel casing having a top threaded region (120) which has both external threads (101) and internal threads (102) which internal threads (102) mate to the external threads (122) of the fuze (121), and;

said main piece having an aerodynamically contoured section (103) below said top threaded region (120), and a straight cylindrical area (104) below said contoured section (103), and;

a circumferential obturator slot (105) engraved circumferentially below said straight cylindrical area (104), and;

a tapered down area (106) below said circumferential obturator slot (105), and;

a bottom threaded region (107) having outer threads (108), and;

a hollow tail piece (500) having a top tail piece (504) with internal threads (501) which mate to outer threads (108) of said bottom threaded region (107), and;

a tail tube piece (505) having multiple holes (502) therein and having hollow propellant donuts (506) mounted thereon, and;

a fin assembly (511) at base of said tail tube piece (505), said fin assembly (511) having five fins (503) thereupon, and;

a fragment containing device (200) sized to be selectively emplaced over or selectively removed from, said straight cylindrical area (104) of said main piece (100) and said specially contoured section (103), said fragment containing device (200) comprising a lower hollow cylindrical cup area (201) and an upper rounded hollow piece (202), wherein a band (204) of vehicle or armor defeating metal ball fragments (208) are embedded within the outside surface of cup area (201) and a band (205) of personnel defeating metal ball fragments (209) are embedded within the outside surface of rounded hollow piece (202), and; a hollow spacer (300) sized to fit completely over or under the upper rounded hollow piece (202) of the fragment containing device (200), and; an aerodynamically shaped hollow aluminum cowling (400) having in its top part, internal threads (401) which are sized to screw down over outer threads (101) of the main piece (100), and; said round carrying a payload of insensitive IMX-104 high explosive (150) within.

2. A mortar ammunition round comprising a fragmenting warhead that may be customized for mission needs, said round comprising:

a main piece (100), said main piece comprising a hollow fragmenting body, HF-1 steel casing, and;

a fragment containing device (200) sized to be selectively emplaced over or selectively removed from said main piece (100), said fragment containing device (200) comprising a lower hollow cylindrical cup area (201) and an upper rounded hollow piece (202), wherein a band (204) of vehicle or armor defeating fragments (208) are embedded within the outside surface of cup area (201) and a band (205) of personnel defeating fragments (209) are embedded within the outside surface of rounded hollow piece (202), and;

a hollow spacer (300) sized to fit completely over the upper rounded hollow piece (202) of the fragment containing device (200), and;

an aerodynamically shaped hollow aluminum outer cowling (400) attached to cover over said main piece (100), said fragment containing device (200), and said hollow spacer (300); and, wherein said cowling (400), hollow spacer (300), and fragment containing device (200) are selectively removable so that said fragment containing device (200) may be replaced with different fragment bands (204) and (205) selected to fit changing mission needs.

3. The mortar ammunition round of claim 2 wherein fragments (208) and (209) are metal balls and wherein fragments (208) are larger than fragments (209).

4. The mortar ammunition round of claim 3 wherein the fragments are of steel.

5. The mortar ammunition round of claim 3 wherein the fragments are of tungsten.

6. The mortar ammunition round of claim 3 wherein the cowling (400) is made of a metallic, polymer, ceramic, or a composite material.

7. The mortar ammunition round of claim 3 wherein the fragments comprise geometric shapes other than balls.

8. The mortar ammunition round of claim 2 wherein the fragments (208) and (209) are of heavy metals.

9. The mortar ammunition round of claim 2 further including a fuze (121), and wherein fuze (121), said cowling, and said main fuze (100), are selectively attached together by screw threading means.

10. The mortar ammunition round of claim 9 wherein detaching said cowling provides access to said fragment bands (204), (205) and the possibility of changing the entire fragment containing device (200).

* * * * *